United States Patent [19]

Lin

[11] Patent Number: 4,893,529

[45] Date of Patent: Jan. 16, 1990

[54] STORAGE TYPE HEXAGONAL SOCKET WRENCH

[76] Inventor: Schih-Chang Lin, No. 102, Lane 222 Hsin-Chung Rd., Ho-Mei Town, Chang-Hua, Taiwan

[21] Appl. No.: 296,131

[22] Filed: Jan. 12, 1989

[51] Int. Cl.[4] ..... B25G 1/08; B25B 23/00

[52] U.S. Cl. ..... 81/177.1; 81/439; 81/490

[58] Field of Search ..... 81/177.4, 437–440, 81/490; 7/167

[56] References Cited

U.S. PATENT DOCUMENTS 4,572,038 2/1986 Coraham ..... 81/439

4,653,356 3/1987 Golden ..... 81/177.4 X

*Primary Examiner*—D. S. Meislin

*Attorney, Agent, or Firm*—Birch, Stewart Kolasch & Birch

[57] ABSTRACT

A storage type hexagonal socket wrench including a handle, a driving shaft, a socket, a back seat, a rotatable storage wheel, a front seat, one set of socket wrench elements and a spring wherein the handle is comprised of a main handle grip and an auxiliary handle bar pivotally mounted therein whereby the auxiliary handle bar can be alternatively switched open to form a T-shaped configuration for each operation by both hands. The socket has a hexagonal outer configuration and a hexagonal hole in one end to receive the shaft and a pentagonal hole in the front portion. The back seat comprising a circular block having a hexagonal tube extended therefrom. The hexagonal tube having a hexagonal opening for the socket to slide thereinside, and a flange at the rear end to protrude inward so as to form a reduced hexagonal hole for insertion of said driving shaft, an axle extends from the central portion of the circular block. A rotatable storage wheel having a hole for insertion therethrough of the axle in a manner that the rotatable storage wheel is revolvably mounted on the back seat, six hexagonal holes are equidistantly positioned around the hole with a respective stop lug at the rear end of each hexagonal hole. The front seat being a circular block having a hexagonal tube horizontally extended therefrom with a flange protruding inward to form a reduced hexagonal hole. The front seat and the back seat are secured together. The socket wrench elements each have a hexagonal central portion which is slidable in a hole of the rotatable storage wheel and in the hexagonal tube of the front seat and a pentagonal post with a slot therein to receive a steel ball in order to provide a connection with the pentagonal hole of the socket.

3 Claims, 6 Drawing Sheets

STORAGE TYPE HEXAGONAL SOCKET WRENCH

BACKGROUND OF THE INVENTION

The present invention relates to a storage type hexagonal socket wrench and, more particularly to a hexagonal socket wrench having one set of hexagonal socket wrench elements in a variety of sizes for selective use.

This invention is derived from an improvement made on a conventional storage type screw driver. Please refer to the illustration of the the conventional storage type screw driver shown in FIG. 1. The screw driver comprises a handle (1), a driving shaft (2), a nut (3), a washer (4), a back seat (5), a locating ring (6), a rotatable storage wheel (7), a front seat (8), a spring (9), a locating block (901), a bolt (902), and one set of driving elements (101), (102), . . . etc., wherein a control switch (201) is provided between the handle (1) and the driving shaft (2) to control forward or backward, i.e. clockwise or counterclockwise rotation. The driving shaft (2) comprises a cylindrical portion (202) at the front having notches (203) and (204) therein, as illustrated in FIGS. 3 and 4, and the driving shaft (2) also comprises a locating hole (205) made at the rear portion. The nut (3) has a cylindrical outer configuration, comprising an inner thread (301), and a reduced round hole (302) at the rear end for insertion therethrough of the driving shaft (2). A locating pin (206) is set in the locating hole (205) of the driving shaft (2) with a small portion protruding therebeyond to prevent the nut (3) from breaking away.

The back seat (5) includes a tube-like extension (502) extending rearwardly which has a hexagonal opening (501); therein, and thread (503) thereon. The driving shaft (2) is arranged to pass through the washer (4) and the hexagonal opening (501) of the back seat (5) to further be connected with the back seat (5) by means of threaded engagement of the nut (3) with the thread (503) of the tubular extension (502). The back seat (5) comprises a revolving axle (504) at the front-central portion having a bolt hole made therein at the middle portion (not illustrated in the drawing). The locating ring (6) comprises a convex outer and concave contour similar to the back seat (5), rotatable storage wheel (7) and the front seat (8), having a round hole at the inner portion including a notch (602). The rotatable storage wheel (7) comprises an axial hole (701) and 6 other holes (702), (703), (704), (705), (706), and (707) equidistantly arranged around the axial hole (701) for respectively receiving the driving elements (101), (102), The portions (103) and (104) at the rear end (referring to the element (101) as illustrated in FIG. 1) respectively match with the notches (203) and (204) of the driving shaft (2) wherein the protruding portion (104) and the cylindrical body of the driving element forms a notch (105). The front seat (8) comprises a tubular body (802) at the front having an axially extending round hole (801) therein, another round hole (803) arranged at the back side for receiving the spring (9) and locating block (901), and a hole (804) located at the back center for insertion therethrough of the bolt (902) to further threadedly engage with the bolt hole of the revolving axle (504) of the back seat (5) so as to complete the assembly as shown in FIG. 2.

While the driving elements (101), (102), . . . are stored in the respective holes (702), (703), . . . of the rotating wheel (7), the notch (105) of each element is retained by the locating ring (6) to prevent the element from moving away. To operate, the driving shaft (2) is pulled backward to the limit, and the rotating wheel (7) is revolved to align the preferred driving element with the driving shaft (2), i.e. to let the protruding portions (103) and (104) of the preferred driving element be respectively set in the notches (203) and (204) of the driving shaft (2). After fixation of the preferred driving element with the driving shaft (2), the driving shaft (2) is pushed ahead to force the preferred driving element away from the rotatable wheel (7) to further protrude beyond the tubular body (802) of the front seat for screw-driving application. When another size of driving element is required, the driving shaft (2) is pulled backward to the limit, then the procedures are followed as above-described. Further, the rotatable wheel (7) may be marked with the respective sizes of the driving elements on the outer surface of the respective holes (702), (703), . . . etc., to facilitate selection.

Although this storage type screw driver can provide a plurality of driving elements for alternative application, it is not practical for application as a hexagonal socket wrench because of the below described disadvantages.

<A> The rotation of the driving element (101), (102), . . . etc., is provided through the engagement of the protruding portion (103) with respective notch (203). This structure is not strong enough for driving large size hexagonal socket wrench elements.

<B> The driving element (101), (102), . . . which comprises a protruding portion (103), (104) requires a complicated process to produce. In consequence, the manufacturing cost is expensive.

<C> The driving lever (2) which comprises front notches (203) and (204) also requires a complicated process to produce, so that the manufacturing cost is high.

<D> While assembling, each driving element (101), (102), . . . should be properly arranged to let the notch (105) be retained at the round hole (601) of the locating ring (6). Therefore, it is difficult to assemble the component parts.

<E> It provides a short torque arm which is not practical for the application of the heavy torque force required to drive a hexagonal socket wrench element. The handle and the driving lever shaft are arranged in an L-shaped configuration, to which the torque force is more difficult to apply.

The present invention is directed to making use of the advantage of a storage type screw driver to carry a variety of driving elements for alternative application with an improvement being made on the structure for application of bigger torque force to drive a hexagonal socket wrench.

SUMMARY OF THE INVENTION

The main object of the present invention is to provide a storage type hexagonal socket wrench which is simple in structure and applicable to bear the heavy torque force applied by both hands to efficiently drive a socket wrench element for application and, which includes a handle having a holding portion for hands to hold, and a means made at the front to control forward and backward, i.e. clockwise or counterclockwise, rotation;

a driving shaft having a hexagonal rod-like configuration, being connected to the forward and backward rotation control means of the handle at the rear end, applicable to make forward and backward rotation against the handle;

a socket having a hexagonal outer configuration, comprising a hexagonal hole in the rear portion for the hexagonal front end of said driving lever to set therein, a pentagonal hole made on the front portion, a steel ball and an elastic element located on one of the lateral sides for position fixation of a socket wrench element, and a longitudinal groove located at a side opposite the side where the steel ball and elastic element are located;

a back seat comprising a circular block having a hexagonal tube extending rearwardly, the said hexagonal tube being properly arranged to provide a hexagonal opening suitable for the socket to slide thereinside, and having a flange at the rear end protruding inwardly so as to form a reduced hexagonal hole for insertion of the driving shaft, a revolving axle being integrally made with the back seat at the front extending from the central portion of the circular block;

a rotatable storage wheel comprising an axial round hole at the center for insertion therethrough of the revolving axle so that the rotatable wheel is revolvably mounted on the back seat, six hexagonal holes being equidistantly located around the round hole with a respective stop lug at the rear end of each hexagonal hole;

a front seat being comprised of a circular block including a hexagonal tube horizontally extended from said circular block at the front having a flange protruding inward to form a reduced hexagonal hole, and having a hole at the center for a bolt to connect the front seat, the back seat and the rotating wheel together by means of screw joint;

one set of socket wrench elements, each comprising a hexagonal central portion arranged in a size suitable for sliding in a respective hexagonal hole of said rotating wheel and in the hexagonal tube of said front seat, a pentagonal post of same size extending backward from each element and having a slot respectively made thereon to let the steel ball be retained therein to firmly fix the connection after it is inserted into the pentagonal hole of the socket, and a hexagonal post at the front with the elements having successive sizes.

The above component parts form a storage socket wrench which utilizes the following operation procedure. The driving shaft is pulled backward to seperate the socket from the pentagonal post and is moved back into the hexagonal tube of the back seat. Then the rotatable wheel is revolved so as to select the size of the socket wrench element be aligned with the hexagonal tube of the back seat. Then, the driving shaft is pushed forward to drive the pentagonal post of the selected socket wrench element. Thereafter the driving shaft is continuously pushed forward so as to force the socket wrench element to protrude beyond the hexagonal hole of the front seat to form a hexagonal socket wrench. When changing the socket wrench element, the driving shaft is pulled backward so that the socket wrench element moves backward until the hexagonal central portion of the element is stopped by the stop lug of the rotatable wheel and retained thereinside. The driving shaft is further pulled backward to the limit to let the socket break away from the pentagonal post of the socket wrench element and thus move backward into the hexagonal tube of the back seat so as to let the rotating wheel be revolvable for selection of another preferred size of socket wrench element.

Another object of the present invention is to provide a storage type hexagonal socket wrench wherein the handle is comprised of a main handle grip and an auxiliary handle bar. The main handle grip including a slot for receiving the auxiliary handle bar thereinside. The auxiliary handle bar being pivotally connected to the main handle grip to let the auxiliary handle bar be received in the slot of said main handle grip if so desired and to let the auxiliary handle bar be lifted to form a T-shaped handle for convenient holding by both hands at the time heavy torque force is required to drive a large socket wrench.

A yet further object of the present invention is to provide a storage type hexagonal socket wrench wherein the rotatable storage wheel has a set of notches which cooperate with a match with one set of noses made on said front seat along a spring is provided between the rotatable storage wheel and the back seat to force the noses into respective notches to secure engagement with each other, such that a sound is generated during revolving of the rotatable wheel against the front seat which ensures the connection of the noses with the notches.

The above-described and other objects, features, advantages of the present invention will be more apparent from the following description quoted on the basis of annexed drawings as hereunder.

DETAILED DESCRIPTION OF THE PREFERRED EMBODIMENT

Figure 1:
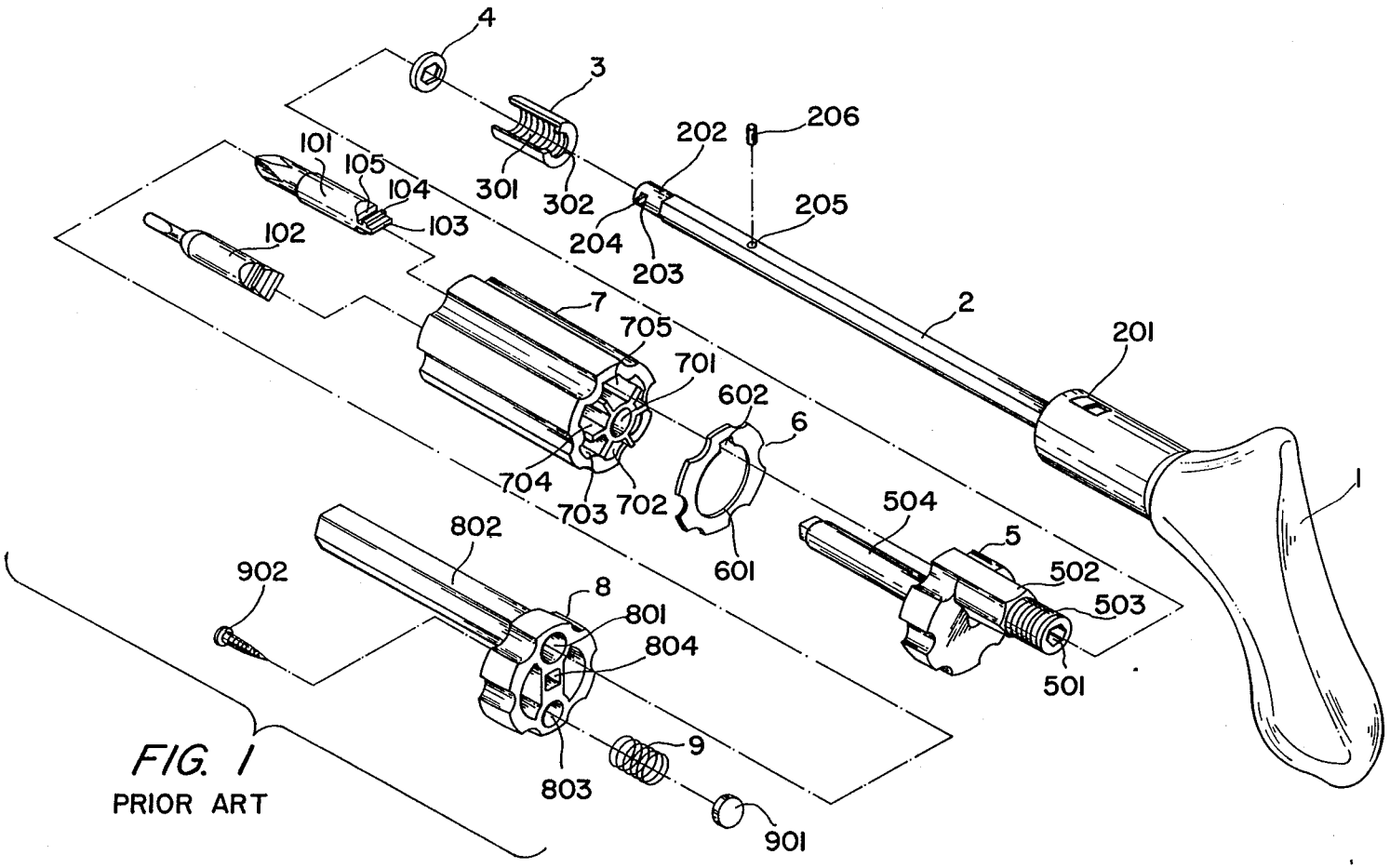
FIG. 1 PRIOR ART
FIG. 1 is a perspective fragmentary view of a storage type screw driver.
Figure 2:
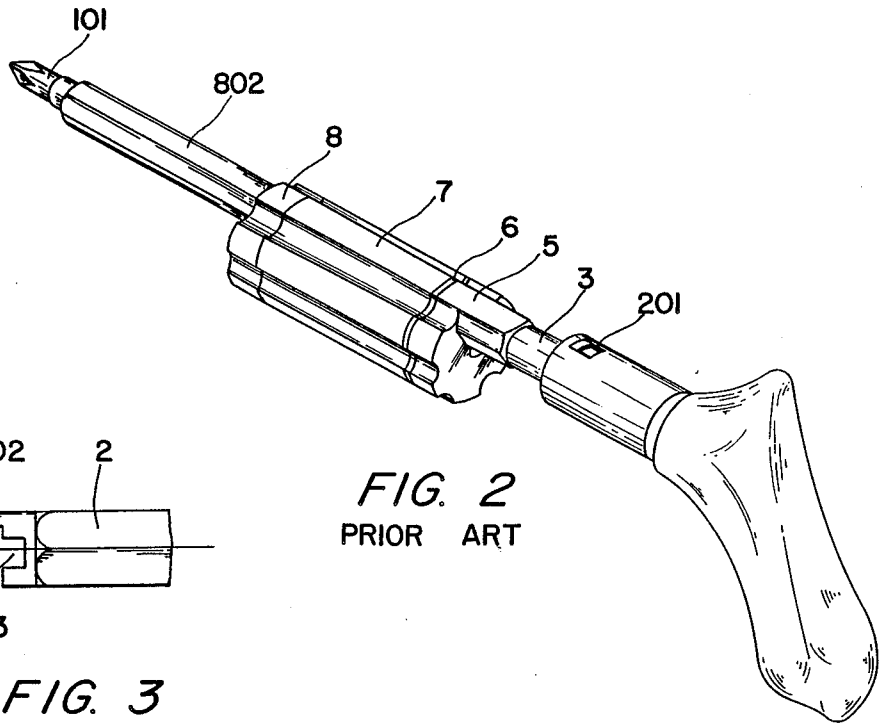
FIG. 2 PRIOR ART
FIG. 2 shows a perspective view of a storage type screw driver.
Figure 3:
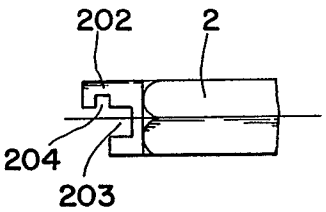
FIG. 3 PRIOR ART
FIG. 3 is a longitudinal sectional view of the front structure of the driving lever of the screw driver of FIG. 2.
Figure 4:
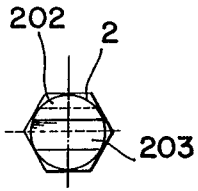
FIG. 4 PRIOR ART
FIG. 4 is a cross sectional view of the front structure of the driving lever of the screw driver of FIG. 2.
Figure 5:
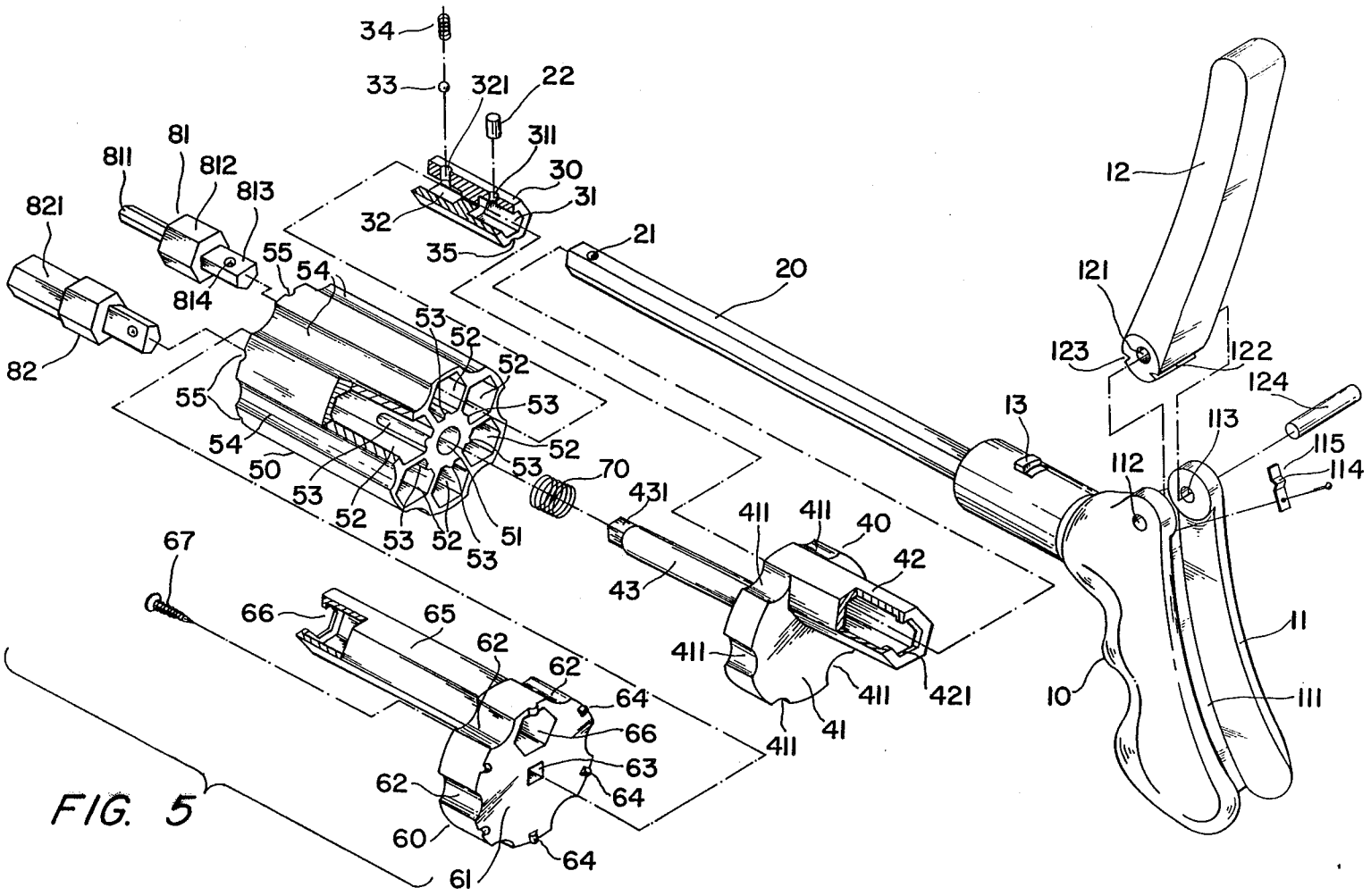
FIG. 5 is a fragmentary perspective view of a storage type hexagonal socket wrench embodying the present invention.
Figure 6:
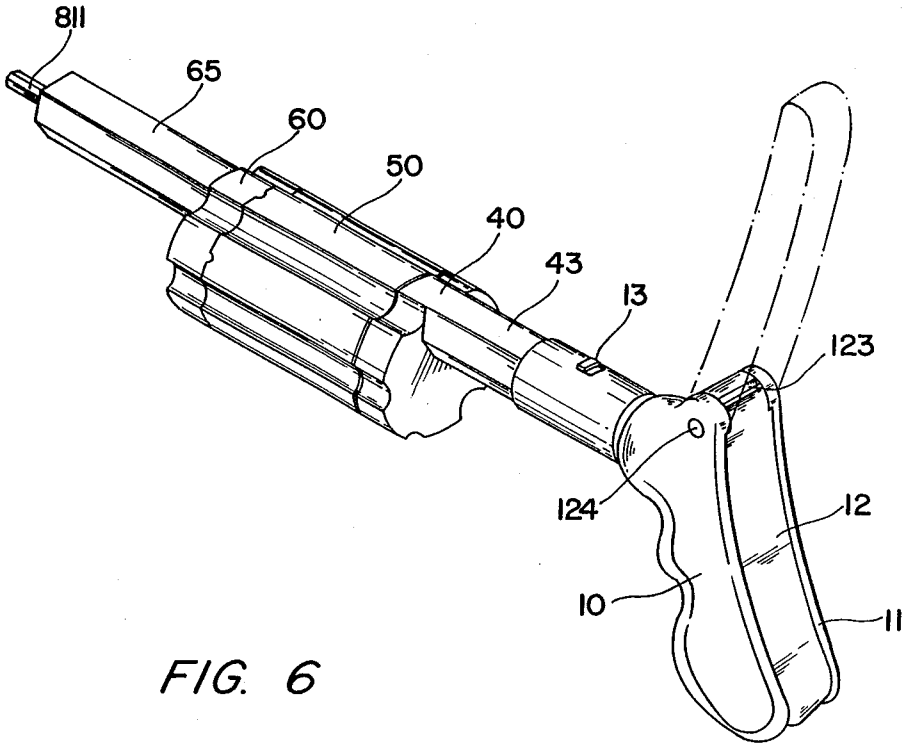
FIG. 6 is a perspective assembly view of the preferred embodiment.

Referring to FIG. 5, a storage type hexagonal socket wrench comprises a handle (10), a driving shaft (20), a socket (30), a rotatable back seat (40), a storage wheel (50), a front seat (60), a spring (70), and one set of hexagonal socket wrench elements (81) and (82), . . . etc.

Figure 10:
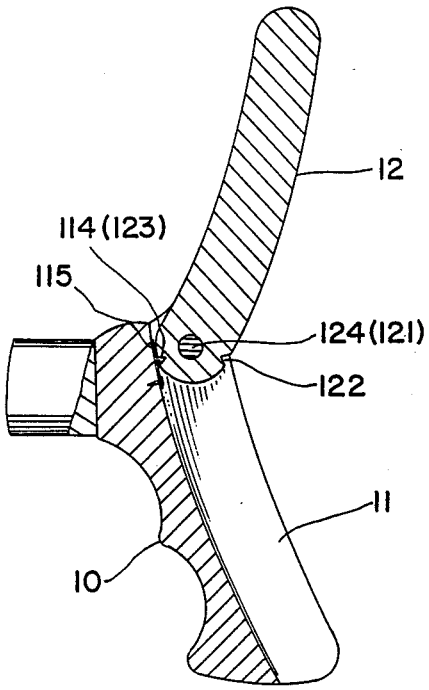
FIGS. 9 and 10 illustrate the operation of the handle of the preferred embodiment.
Figure 9:
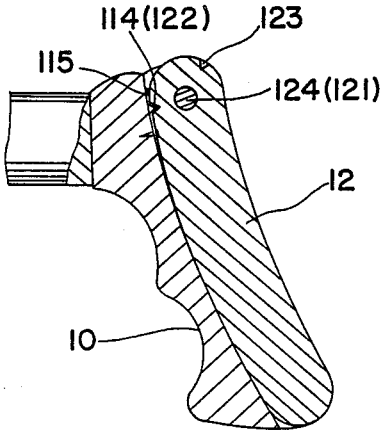

The handle (10) is comprised of a main handle grip (11) and an auxiliary handle bar (12). The main handle grip (11) comprises a means (13) at the front to control forward and backward, i.e. clockwise and counterclockwise, rotation, a slot (111) is provided for receiving the auxiliary handle bar (12) thereinside, two locating holes (112) and (113) bilaterally made at the front, a spring leaf (115) having a protruding portion (114) arranged inside the slot (111). Said auxiliary handle bar (12) which comprises a round hole (121) and two notches (122) and (123) made at the top end, is pivotally connected to said main handle grip (11) by means of a pin (124) to insert through the round hole (121) and the locating holes (112) and (113). Please refer to FIG. 9. When the auxiliary handle bar (12) is received in the slot (111) of said main handle grip (11), the protruding portion (114) of said spring leaf (115) is set in the notch (122) to position the auxiliary handle bar (12) firmly therein. When the auxiliary handle bar (12) is lifted, as shown in FIG. 10, the protruding portion (114) is shifted to set in the notch (123) so that the auxiliary handle bar (12) is firmly positioned in an opened status to form a T-shaped handle (10) for convenient holding by both hands to apply force.

The driving shaft (20), in the present embodiment, is a hexagonal shaft, which may have any configuration, connected to the forward and backward rotation control means (13) of said handle (10) at the rear end, and having a locating hole (21) positioned at the front end.

The socket (30) has a hexagonal outer configuration, comprised of a front portion and a rear portion. A hexagonal hole (31) is made in the rear portion receive the hexagonal front end of the driving shaft (20) therein a locating pin (22) is inserted in the hole (311) and the locating hole (21) so as to firmly connect the socket (30) and the driving shaft (20). A pentagonal hole (32) is made in the front portion (the pentagonal hole is derived from the hexagonal hole of the rear portion of the socket by reducing one lateral side). A hole (321) is made on the wider lateral side of pentagonal hole (32) for receiving a steel ball (33) and a spring (34). The hole (321) has a smaller inner diameter at the inner portion to let the steel ball (33) be exposed in the pentagonal hole (32). A C-ring may be provided and retained at a circular notch made in the socket to force the steel ball (33) toward the axle center. A longitudinal groove (35) is made in the socket (30) at the side opposite from the side having the hole (321) for the steel ball (30).

The back seat (40) comprises a circular block (41) having 6 concave portions (411) located around the circumference, a hexagonal tube (42) extends rearwardly from the circular block and is horizontally disposed. The hexagonal tube (42) is properly arranged to provide a hexagonal caliber suitable for the socket (30) to slide thereinside, and has a flange at the rear end protruding inward so as to form a reduced hexagonal hole (421). A revolving axle (43) is integrally made with the back seat (40) at the front and extends from the central portion of the circular block (41). The revolving axle (43) has a square portion (431) at the front and a bolt hole located in the square portion (431) (referring to FIGS. 7 and 8). While in assembly, the driving shaft (20) is inserted through the hexagonal hole (421) of the back seat (40) and through the hexagonal hole (31) of the socket (30) to be fixed thereto by means of the locating pin (22), such that the back seat (40), the driving shaft (20) and the socket (30) are coupled together.

The rotatable storage wheel (50) comprises a round hole (54) made at the center axis thereof for insertion therethrough of the revolving axle (43) in a manner such that the rotatable wheel (50) is revolvably mounted on the back seat (40). Six hexagonal holes (52) are equidistantly positioned around the round hole (54) with a respective stop lug (53) at the rear end of each hexagonal hole (52). The outer appearance of the rotating wheel (50), which is similar to the back seat, is arranged to provide 6 concave portions (54). A notch (55) is made in each hexagonal hole (52) at the front.

The front seat (60) is comprised of a circular block (61) having 6 concave portions (62) located around the circumference, a square hole (63) at the center and a round hole at the inner side (please refer to FIGS. 7 and 8), and 6 noses (64) equidistantly positioned at the back side around the circumference. A hexagonal tube (65) is horizontally forwardly extended from the circular block (61) and has a flange protruding inward to form a reduced hexagonal hole (66).

While in assembly, a spring (70) is mounted on the revolving axle (43). The rotating wheel (50) is then mounted on the revolving axle (43) too. The front seat (60) is arranged to let the hexagonal tube (65) be aligned with the hexagonal tube (42) of the back seat (40) letting the square portion (431) enter into the square hole (63). A bolt (67) is inserted through the round hole and the square hole (63) of the front seat (60) to thread in the front bolt hole of the square portion (431) such that the front seat (60), back seat (40), and rotating wheel (50) are connected together, wherein the rotating wheel (50) is forced by the spring (70) to constantly push the front seat (60) ahead to let the noses (64) be positioned in the respective notches (55).

A sound is generated during revolving of the rotating wheel against the front seat so as to make sure of the right position of the connections of said noses with said notches. The said hexagonal socket wrench elements (81), (82) . . . etc., are stored in the hexagonal holes (52) of the rotatable wheel (50) respectively. Each socket wrench element comprises a hexagonal post (811), (821) . . . at the front arranged in successive size. The central and rear portion of all socket wrench elements are exactly the same. For fuller understanding of such structure, an element (81) is taken as an example for description. The element (81) comprises a hexagonal central portion (812) having in a size suitable to slide in each hexagonal hole (52) of the rotatable wheel (50) and in the hexagonal tube (65) of the front seat (60), a pentagonal post (813) extending backward having a slot (814) therein (813) to let the steel ball (33) be retained in place to firmly fix the connection after the element is inserted into the pentagonal hole (32) of socket (30).

Figure 7:
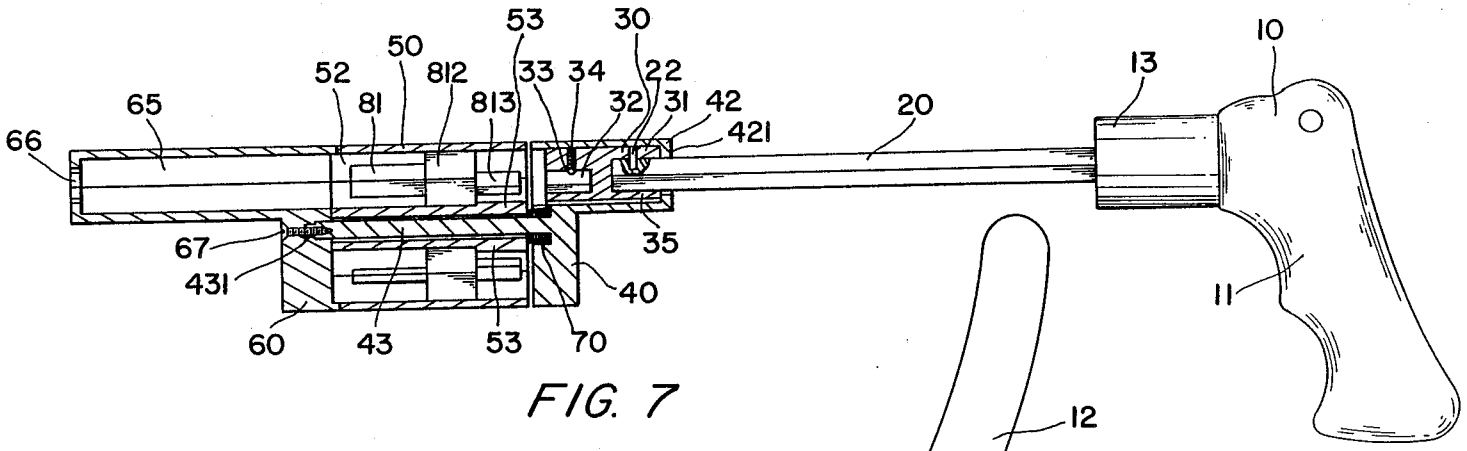
FIGS. 7 and 8 show a sectional view the operation of the preferred embodiment, illustrating the operational procedure.
Figure 8:
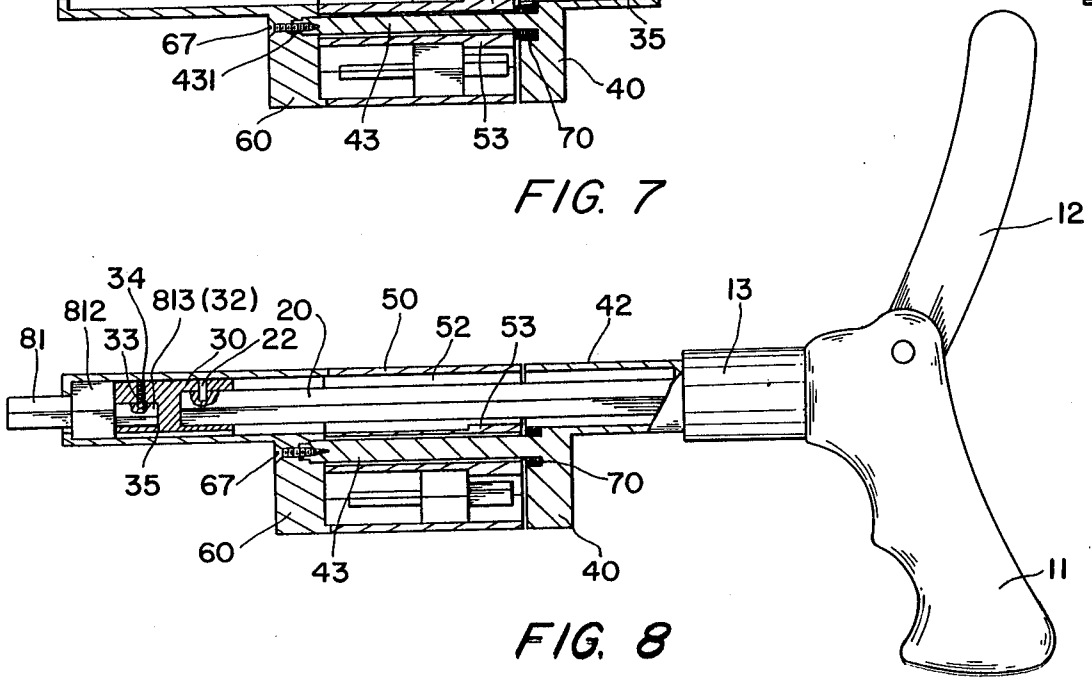

Please refer to FIGS. 7 and 8 for an illustration of the operation used to replace a socket wrench element (81), (82) . . . etc. The driving shaft (20) is pulled backward to the limit to let the pentagonal hole (32) of the socket (30) break away from the pentagonal post (813) of the element (81) and to let the socket (30) be moved back into the hexagonal tube (42) of the back seat (40). The rotatable wheel (50) is then revolved to let the noses (64) break away from respective notches (55) and to let the spring (70) be compressed. The rotatable wheel (50) is further revolved continuously to let the noses (64) be respectively set into the notches (55) again. When the preferred size of socket wrench element has been selected, the driving shaft (20) is pushed forward to force the pentagonal hole (32) of the socket (30) ahead to engage the pentagonal post of the selected socket wrench element (81) in the hole (32). When the driving shaft (20) is continuously pushed forward, the socket wrench element will be forced to protrude beyond the hexagonal hole (66) of the front seat (60). The auxiliary handle bar (12) is selectively positioned to let the device be stably and conveniently as operated providing well as for easy storage. When it is desired change the element, the driving shaft (20) is pulled backward to the limit, the hexagonal central portion of the element is stopped by the stop lug (53) of the rotating wheel (50) and is retained thereinside, and the socket (30) which is not stopped by the stop lug (53) because of the effect of the longitudinal groove (35) is drawn backward into the hexagonal tube (42) of the back seat. Therefore, the rotating wheel (50) is revolvable for alternative selection of an element to align with the socket. By means of repeated procedures as above-described, replacement of a socket wrench element becomes practical and easy.

According to the present invention, the socket (30) is provided for respective connection with the driving shaft (20) and the element (81), (82) . . . , thus the structure can accept higher torque force to drive the socket wrench element for application as desired. Further, the handle (10) is comprised of a main handle grip (11) and an auxiliary handle bar (12) to selectively form a T-shaped structure for effectively holding by both hands such that stable and strong torque force can be applied. According to the present invention, all the component parts are simple and inexpensive to manufacture. The hexagonal central portion of each socket wrench element may be produced by means of shape-forming process through plastic pouring to reduce the cost because the hexagonal central portion does not bear the applied force. Further, the size of the elements is properly arranged to prevent them from being twisted.

In general, the present invention is to provide a storage type hexagonal socket wrench having numerous features, each of which tends to make the structure more practical and utilitarian as well as inexpensive to manufacture and durable in use.

I claim:

1. A storage type hexagonal socket wrench comprising a handle for manual operation of said wrench, a driving shaft having a front portion, a rear portion and a hexagonal rod-like configuration, control means located on said handle and selectively connecting said rear portion of said driving shaft for either clockwise or counterclockwise rotation of said driving shaft, a socket having a front portion, a rear portion and a hexagonal outer configuration, said socket having a hexagonal hole in the rear portion thereof which receives said front end of said driving shaft, said socket also having a pentagonal hole in said front portion, an opening being positioned between said pentagonal hole and a first exterior side of said socket, said opening having a steel ball and an elastic element located therein, a longitudinal groove is located on a second exterior side of said socket which is parallel to said first exterior side, a back seat having a front face, a rear face and comprising a circular block, a hexagonal tube extending from said rear face and slidably receiving said socket therein, said hexagonal tube having a flange to form a reduced hexagonal hole for insertion of said driving shaft, an axle being integral with said back seat and extending from a central portion of said front face, a rotatable storage wheel having a center is rotably mounted on said axle, a plurality of hexagonal holes having front and rear ends are located equidistantly around said center of said rotatable storage wheel, a stop lug being located on said rotatable wheel at the rear end of each hexagonal hole, a front seat having a front face, a rear face and comprising a circular block, a hexagonal tube extending from said front face of said front seat, said hexagonal tube having a flange protruding inward to form a reduced hexagonal hole, bolt means for connecting said front seat and said rear seat together, a set of socket wrench elements being positioned in said plurality of hexagonal holes in said rotating storage wheel, each of said wrench elements having a hexagonal central portion of a size suitable for sliding in said plurality of hexagonal holes and in the hexagonal tube of said front seat, each of said wrench elements also having a rear portion for insertion in said socket, said rear portion being a pentagonal post with a slot therein for receiving said steel ball to firmly fix the connection after said rear portion is inserted into said pentagonal hole of said socket, whereby the following procedure may be followed in order to select a desired wrench element, the driving shaft is pulled backward to let said socket be separated from the pentagonal post of an engaged wrench element so that the driving shaft is positioned in the hexagonal tube of said back seat while the hexagonal central portion of the wrench element is stopped by a stop lug of said rotatable wheel and retained inside thereof, then said rotatable wheel is revolved so that the selected socket wrench element is aligned with the hexagonal tube of said back seat, then, said driving shaft is pushed forward to drive the pentagonal post of the selected socket wrench element, thereafter, said driving shaft is continuously pushed forward so that the desired socket wrench element is forced to protrude beyond the hexagonal hole of said front seat to form an operative hexagonal socket wrench.

2. A storage type hexagonal socket wrench according to claim 1 wherein said handle is comprised of a main handle grip and an auxiliary handle bar, said main handle grip having a slot for receiving said auxiliary handle bar, said auxiliary handle bar being pivotally connected to said main handle grip to let said auxiliary handle bar be received in the slot of said main handle grip and to let said auxiliary handle bar be lifted to form a T-shaped handle for convenient holding by both hands when heavy torque force is required to drive a large socket wrench.

3. A storage type hexagonal socket wrench according to claim 1 wherein said rotatable storage wheel has a set of notches thereon which cooperate with a set of noses located on said front seat; a spring being provided between said rotatable storage wheel and said back seat to force said noses toward said notches to secure engagement, such that a sound is generated during revolving of said rotatable storage wheel against said front seat so as to ensure the connection of said noses with said notches.

* * * * *